US007406790B2

(12) United States Patent
Gnesa

(10) Patent No.: US 7,406,790 B2
(45) Date of Patent: Aug. 5, 2008

(54) LABELING SYSTEM FOR COIL BINDERS

(76) Inventor: Aric M. Gnesa, 3440 Florida St., #5, San Diego, CA (US) 92104

( * ) Notice: Subject to any disclaimer, the term of this patent is extended or adjusted under 35 U.S.C. 154(b) by 0 days.

(21) Appl. No.: 11/555,355

(22) Filed: Nov. 1, 2006

(65) Prior Publication Data

US 2008/0141573 A1 Jun. 19, 2008

(51) Int. Cl.
*B42F 13/40* (2006.01)

(52) U.S. Cl. ..... 40/658; 402/57; 402/3

(58) Field of Classification Search ..... 40/316, 40/663, 652, 315, 658, 1.5, 648, 666, 669, 40/660; 281/21.1, 36, 32, 30; 402/57, 3; 24/548, 67.9, 297, 453; 411/508
See application file for complete search history.

(56) References Cited

U.S. PATENT DOCUMENTS 1,221,672 A * 4/1917 Cain ..... 52/261
1,653,346 A * 12/1927 Crump ..... 40/651
1,996,664 A * 4/1935 Walker ..... 281/30
3,159,411 A * 12/1964 William ..... 281/27.3
3,167,328 A * 1/1965 Dengle et al. ..... 281/29
5,476,336 A * 12/1995 Osiecki et al. ..... 402/79
6,672,785 B1 * 1/2004 O'Hara et al. ..... 402/79
7,052,045 B2 * 5/2006 Park ..... 281/36
2003/0213154 A1 * 11/2003 Park ..... 40/647

FOREIGN PATENT DOCUMENTS

FR 2790714 A1 * 9/2000

* cited by examiner

*Primary Examiner*—Cassandra Davis
(74) *Attorney, Agent, or Firm*—Vierra Magen Marcus & DeNiro LLP

(57) ABSTRACT

A labeling member is disclosed which attaches to the coil used for the coil binding of documents. The member may be affixed as an aftermarket upgrade to existing coil binding products. In embodiments, the member serves at least two functions. First, the member presents a face along the edge of a coil which may be marked or labeled to allow identification of the coil bound document when shelved or stacked. Second, the member adds structural rigidity to the bound document when placed vertically on a shelf by making the coil more rigid.

9 Claims, 4 Drawing Sheets

Fig. 5
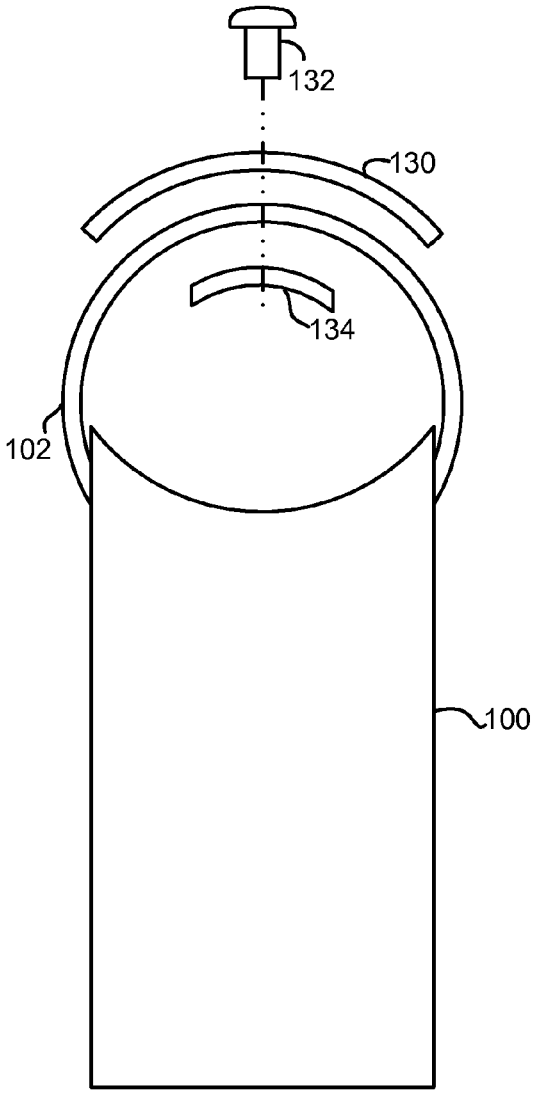
Fig. 6
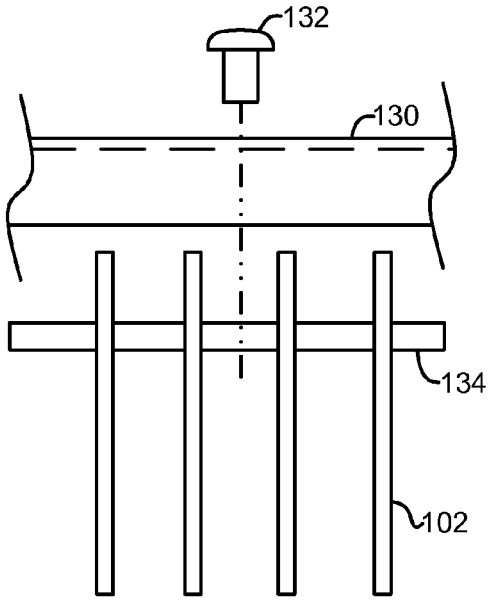
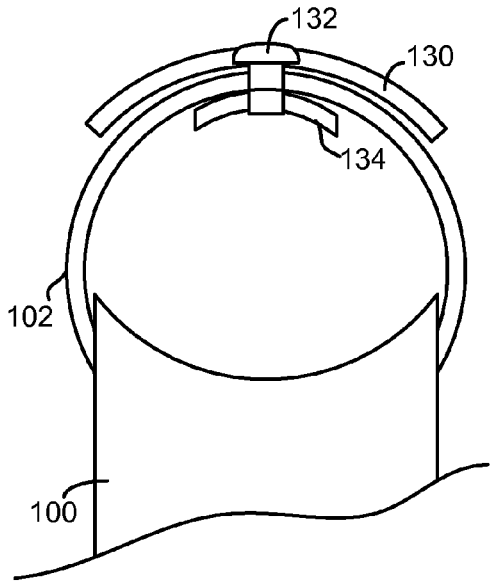
Fig. 7

Fig. 8
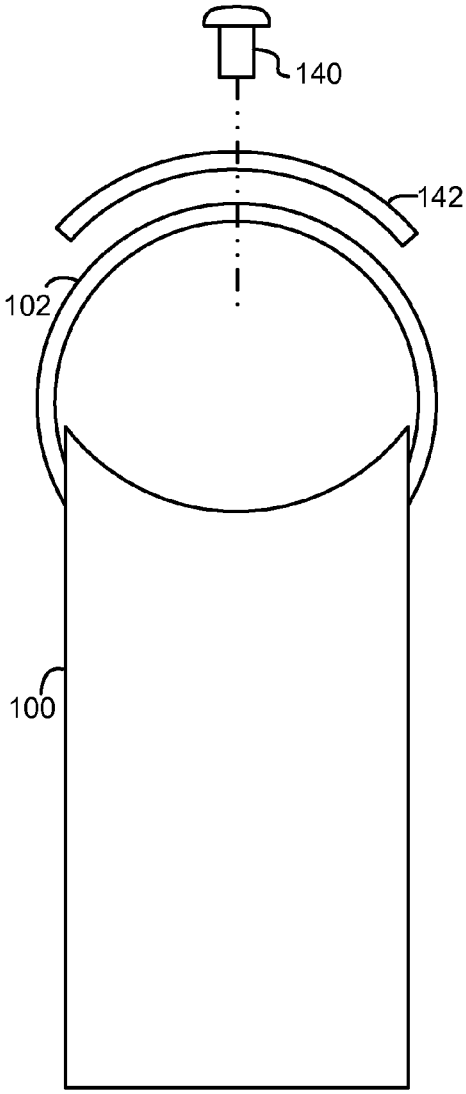
Fig. 9
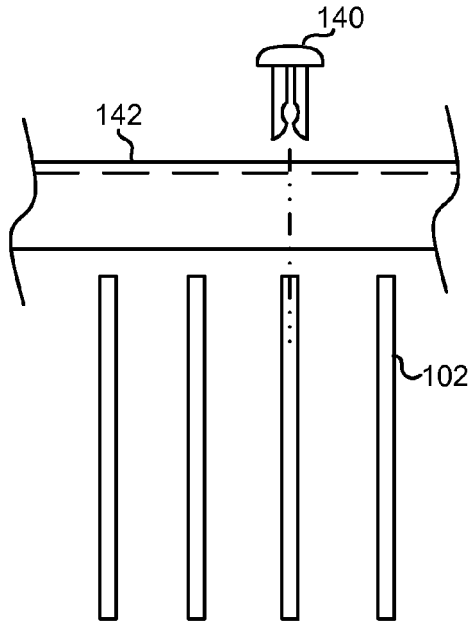
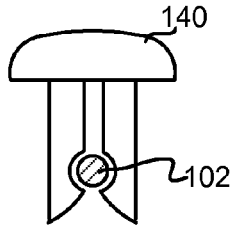
Fig. 10

LABELING SYSTEM FOR COIL BINDERS

BACKGROUND OF THE INVENTION

1. Field of the Invention

The present invention is directed to a labeling system for coil binders, and in particular to an attachment which affixes to a coil binding of a coil binder.

2. Description of the Related Art

Coil binding is a popular means of binding a number of pages together to create reports, studies, and other documents. A coil bound document is formed by initially punching holes along an edge of the document. Then, a flexible coil is spun, or threaded, helically into the document through the punched holes. Most coils are made from a variety of flexible materials, such as PVC plastic or metal, and are available in wide range of diameters, pitches, and lengths to fit different binding needs.

While an effective and efficient method for securely binding documents, coil binding has a disadvantage in that, when shelved or stacked side-by-side with other bound documents, only the coil bound edge of the document is visible. Where other binding methods present a spine which can be printed on, coil bound documents do not. Accordingly, it is difficult to identify coil bound documents which are shelved or stacked.

Co-owned U.S. Pat. Nos. 5,902,659 and 6,447,863, each entitled "Flexible Labeling System," disclose a label, which in embodiments may be applied along an edge of coil bound documents. The disclosed labeling system is comprised of a flexible plastic member incorporating two hinges created by a pair of parallel V-shaped grooves, either continuous or segmented, or perforations which are either die-cut or stamped into the flexible plastic member. The plastic member permits users to provide labeling for coil bound documents.

U.S. Pat. No. 4,840,406, entitled "Method Of Mounting Index Tabs Upon Stenographic Notebooks," discloses an embodiment in FIG. 5 of that reference, where an elongated indexing indicia support base member may be affixed to a coil bound document by a pair of catch members on opposite ends of the base member.

SUMMARY OF THE INVENTION

The present invention, roughly described, relates to a labeling member which attaches to the coil used for the coil binding of documents. The member may be affixed as an aftermarket upgrade to existing coil binding products. In embodiments, the member serves at least two functions. First, the member presents a face along the edge of a coil which may be marked or labeled to allow identification of the coil bound document when shelved or stacked. Second, the member adds structural rigidity to the bound document when placed vertically on a shelf by making the coil more rigid.

BRIEF DESCRIPTION OF THE DRAWINGS

FIG. 5 is an exploded front view of a labeling member for a spiral bound article according to an alternative embodiment of the present invention.

FIG. 6 is a partial exploded side view of a labeling member for a spiral bound article according to the alternative embodiment of the present invention.

FIG. 7 is a front view of a labeling member for a spiral bound article according to the alternative embodiment of the present invention.

FIG. 8 is an exploded front view of a labeling member for a spiral bound article according to a further alternative embodiment of the present invention.

FIG. 9 is a partial exploded side view of a labeling member for a spiral bound article according to the further alternative embodiment of the present invention.

FIG. 10 is an enlarged view of a rivet according to the further alternative embodiment of the present invention.

DETAILED DESCRIPTION

Figure 1:
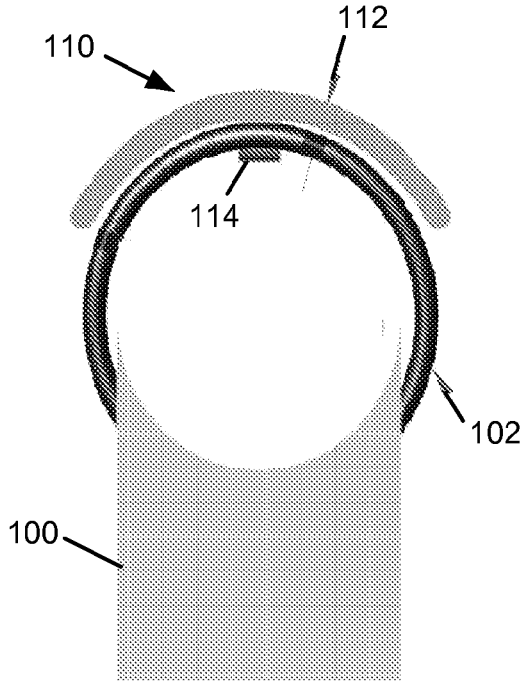
FIG. 1 is a front view of a labeling member affixed to a spiral bound article according to an embodiment of the present invention.

The present invention will now be described with reference to FIGS. 1-10, which in embodiments relates to a labeling system for coil bound documents. It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

Referring now to FIGS. 1-4, there is shown a coil bound article 100 including a coil 102. It is understood that article 100 may be any article which may be bound in a coil-type binding process, including for example documents, albums, and other collections of sheet-type mediums. The type and size of coil 102 used may be any type of coil used in a coil-type binding process. The coil 102 may be formed either entirely or in part from any combination of plastic, metal, wood, fiberglass, carbon fiber, ceramic, composite material, or other materials. The cross-sectional diameter of the material used for the coil may vary in embodiments as is known and the radius of curvature defined by coil may vary in embodiments as is known.

In accordance with the present invention, a labeling member 110 may be affixed to the coil 102 as explained hereinafter. The labeling member 110 may include a spine 112 and fastening clips 114 affixed along the length of an interior surface of the spine 112. Spine 112 may be formed either entirely or in part from any combination of plastic, metal, wood, fiberglass, carbon fiber, ceramic, composite material or other rigid material. The spine 112 may have a length generally equal to the length of coil 102. The length may be less than the length of coil 102 in alternative embodiments, for example one inch long or shorter. Spine 112 may have a thickness of approximately ⅛ inch, but it may be thinner or thicker than that in alternative embodiments. The width of the spine 112 wrapped around the coil 102 may vary from about ¼ inch to several inches, though it may be smaller or larger than that in alternative embodiments. The width may be dependent on the thickness of the article 100 bound by coil 102, or it may be independent of the thickness of article 100. Spine 112 may have a radius of curvature slightly larger than that of the coil 102 so as to fit snugly around the coil. Alternatively, the radius of curvature may be more than slightly larger than that of the coil 102. In further embodiments, the spine 112 may have no radius of curvature, i.e., the spine may be flat.

The spine 112 includes an interior surface facing the coil 102 when affixed thereto as explained hereinafter. The spine further includes an exterior surface opposite the interior surface. The exterior surface is provided for receiving some sort of marking which may identify the article 100. The exterior surface may be provided so that it may be written on with a pen or other writing instrument. Alternatively, the exterior surface may receive an adhesive label for identifying the article 100. In further embodiments, the exterior surface may be pre-printed with a custom label. Alternatively, a clear vinyl label-pocket may be attached to the exterior surface so that an identifying label may be inserted therein.

The fastening clips 114 may be formed on the interior surface of the spine 112. The clips 114 may be integrally formed on the spine during the fabrication of labeling member 110, or the clips may be welded, affixed with adhesive or otherwise adhered to the spine 112 after formation of the spine 112.

Figure 2:
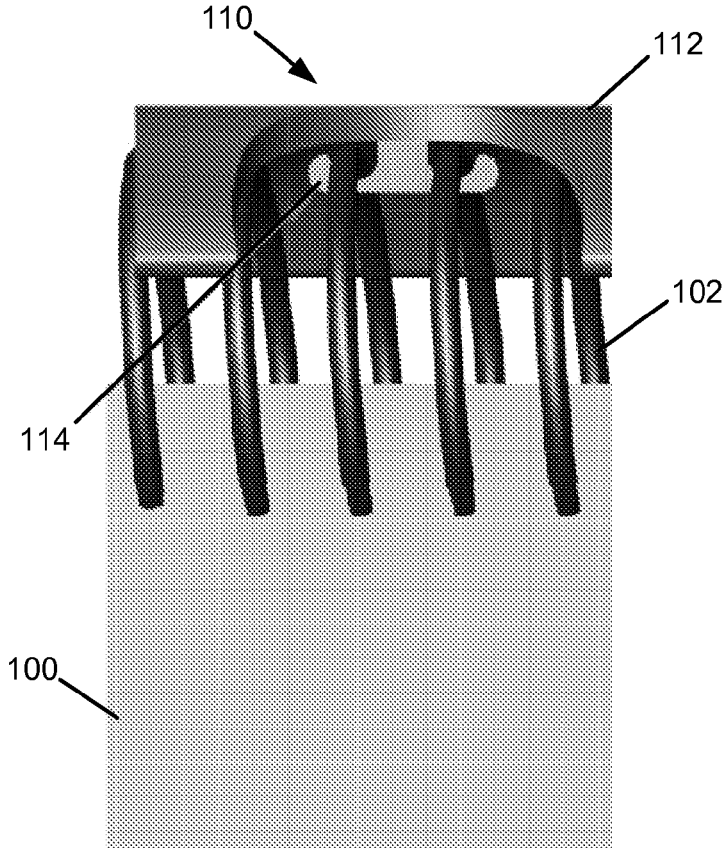
FIG. 2 is a partial side view of a labeling member affixed to a spiral bound article according to an embodiment of the present invention.
Figure 3:
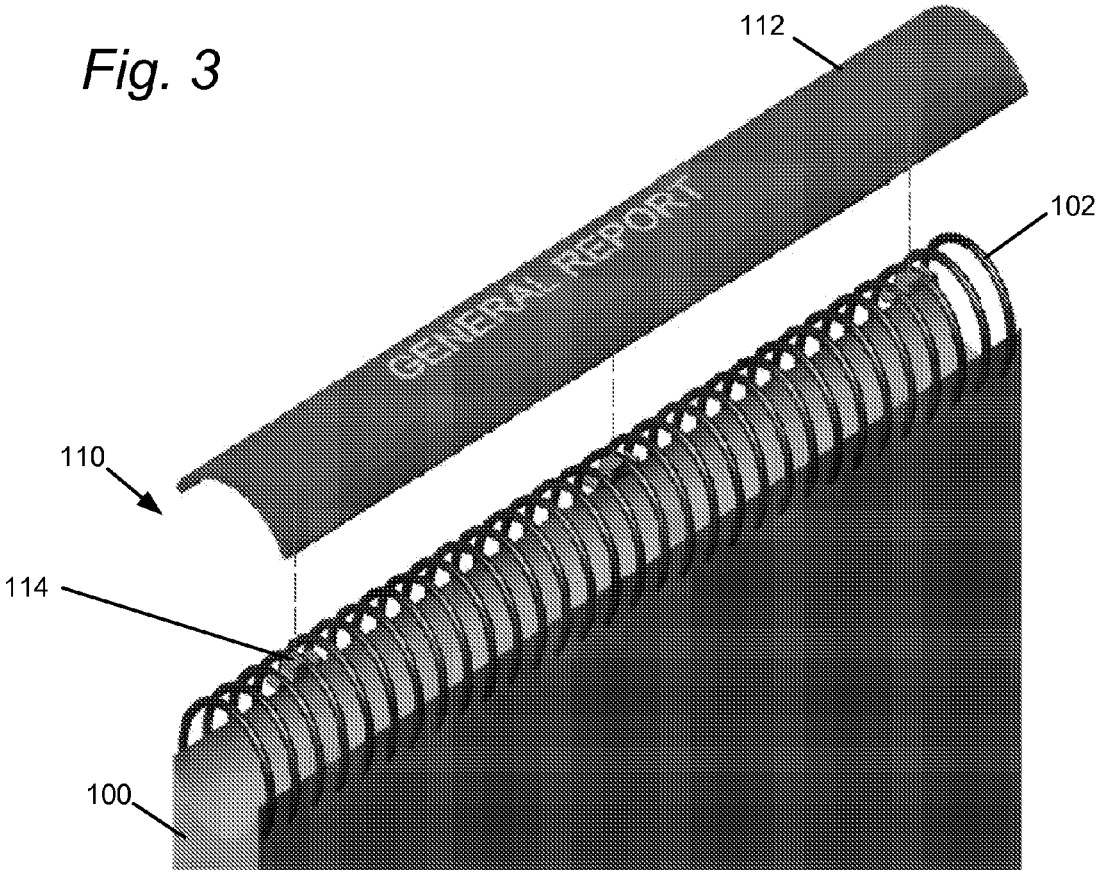
FIG. 3 is an exploded perspective view of a labeling member affixed to a spiral bound article according to an embodiment of the present invention.
Figure 4:
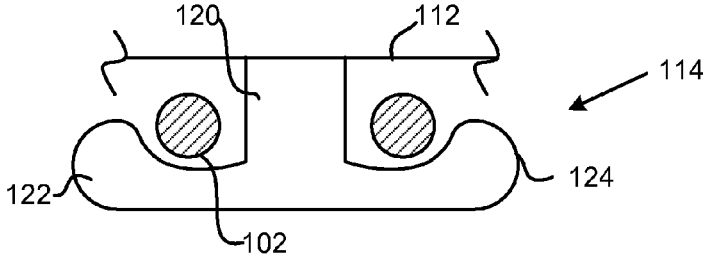
FIG. 4 is an enlarged view of a fastening clip of a labeling member according to an embodiment of the present invention.

There may be two or more fastening clips 114 along the length of spine 112. As best seen in FIGS. 2 through 4, each fastening clip includes a boss 120 (FIG. 4) extending from the interior surface of spine 112. The boss 120 includes a pair of flanges 122, 124 extending from boss 120 to form a generally "T"-shaped fastening clip 114. In order to fasten the labeling member 110 to coil 102, each fastening clip 114 may be inserted in between a pair of adjacent loops of coil 102 (for example by spreading the adjacent loops apart to receive the fastening clip 114 therebetween). Portions of the adjacent loops then seat within the space defined by the flanges, boss and spine 112 for each fastening clip to secure the labeling member 110 to the coil 102. The length of flanges 122, 124 may be provided such that the end-to-end length between flanges 122 and 124 is at least as great as a space between adjacent loops in coil 102 when in an unbiased position.

Each fastening clip 114 may be formed either entirely or in part from any combination of plastic, metal, wood, fiberglass, carbon fiber, ceramic, composite material or other rigid material. There may for example be three fastening clips 114 provided on spine 112 as shown in FIG. 3. However, the number of fastening clips may be less than or greater than three in alternative embodiments. In a further embodiment, there may be between two and ten fastening clips 114, though again, the number of clips may be greater than ten in further embodiments.

The labeling member 110 provides at least two advantages. First, the exterior surface allows spiral-bound articles to be identified when stacked, shelved or otherwise positioned by marking the exterior surface with some identifier. Second, the fastening clips 114 provide structural rigidity to the bound article. For example, when the bound article is supported vertically on a shelf or otherwise, the labeling member 110 prevents the bound article from bending.

It is understood that the fastening clips shown in FIGS. 1 through 4 are one of several possible mechanisms for fastening the labeling member 110 to the coil 102. FIGS. 5 and 6 illustrate front and partial side views, respectively, of a further embodiment of a fastening mechanism for fastening labeling member 110 to a coil 102. In the embodiment of FIGS. 5 and 6, a spine 130 is provided having an exterior surface as explained above. The spine 130 may be provided with holes along its length for receiving a plurality of rivets 132. A rivet receiving member 134 may also be provided having a plurality of holes spaced to match the holes in the spine 130. In order to affix the labeling mechanism of FIGS. 5 and 6, the rivet receiving member 134 may be inserted into the interior of coil 102, and the rivets 132 may then be inserted through the holes in the spine 130 and into the holes in the rivet receiving member 134. The diameter of the rivet shaft and the holes in receiving member 134 are provided so that the ends of the rivets are held firmly within the receiving member 134, as shown in FIG. 7.

A further embodiment shown in FIGS. 8 through 10 may be similar to the embodiment of FIGS. 5 through 7, but the rivet receiving member may be omitted. In the embodiment of FIGS. 8 through 10, a special rivet 140 may be used having a type of clothes pin configuration. The rivet 140 fits through holes in a spine 142, and then around a loop of the coil 102 as best seen in FIG. 10. When the rivet 140 is in place, the loop of coil rests within an opening formed between the respective prongs of the rivet as seen in FIG. 10. In the embodiments of FIGS. 5 through 10, the rivets may be separate from the spine as shown. Alternatively, the interior surface of the spine may be formed with the portions described above that protrude down and in between (FIGS. 5 through 7) or around (FIGS. 8 through 10) the coil loops. It is understood that other fastening mechanisms may be used.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A labeling system for a coil-bound article, the coil bound article bound together by a flexible coil, comprising:

a rigid spine having a length approximately equal to a length of the flexible coil and an exterior surface capable of receiving identifying markings and an interior surface opposite the exterior surface, the rigid spine having a semicircular cross-section wrapping partially around the flexible coil, the semicircular cross-section capable of adding structural rigidity to the flexible coil to keep the flexible coil substantially straight along its length; and a plurality of fastening clips affixed to the spine, the plurality of fastening clips each including a boss extending from the interior surface of the spine, and a pair of flanges extending from the boss in opposite directions from each other, each fastening clip capable of engaging a pair of adjacent loops of the coil to fasten the labeling system to the flexible coil and the plurality of fastening clips capable of adding structural rigidity to the flexible coil to keep the flexible coil substantially straight along its length.

2. A labeling system as recited in claim 1, wherein the plurality of fastening clips are integrally formed with the spine.

3. A labeling system as recited in claim 1, wherein the plurality of fastening clips are affixed to the spine after the spine is formed.

4. A labeling system as recited in claim 1, wherein the labeling system is formed of plastic.

5. A labeling system as recited in claim 1, wherein the labeling system is formed of one or more of plastic, metal, wood, fiberglass, carbon fiber, ceramic, composite material.

6. A labeling system as recited in claim 1, wherein the exterior surface of the spine includes a clear vinyl label-pocket.

7. A labeling system as recited in claim 1, wherein the plurality of fastening clips comprises between three and ten fastening clips.

8. A labeling system as recited in claim 1, wherein the plurality of fastening clips comprises three fastening clips.

9. A labeling system as recited in claim 1, wherein the spine extends substantially the length of the coil.

* * * * *